US006980129B2

(12) United States Patent
Duckeck

(10) Patent No.: US 6,980,129 B2
(45) Date of Patent: Dec. 27, 2005

(54) METHOD FOR DETERMINING AND OUTPUTTING TRAVEL INSTRUCTIONS

(75) Inventor: Ralf Duckeck, Hildesheim (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/900,673

(22) Filed: Jul. 6, 2001

(65) Prior Publication Data

US 2002/0044070 A1 Apr. 18, 2002

(30) Foreign Application Priority Data

Jul. 6, 2000 (DE) ..... 100 32 921

(51) Int. Cl.[7] ..... G08G 1/23

(52) U.S. Cl. ..... 340/988; 340/990; 340/905; 340/995.12; 340/995.13; 340/995.14; 701/210; 701/209; 701/208

(58) Field of Search ..... 340/988, 990, 340/995.12, 995.13, 995.19, 905, 933, 934, 935, 989, 995; 701/207, 208, 209, 210

(56) References Cited

U.S. PATENT DOCUMENTS 5,610,821 A * 3/1997 Gazis et al. ..... 340/988
5,825,283 A * 10/1998 Camhi ..... 340/988
5,875,412 A * 2/1999 Sulich et al. ..... 340/995
6,211,798 B1 * 4/2001 Albrecht et al. ..... 340/990
6,240,363 B1 * 5/2001 Theimer et al. ..... 701/210
6,334,089 B2 * 12/2001 Hessing ..... 340/988
6,336,111 B1 * 1/2002 Ashby et al. ..... 707/4
6,498,985 B1 * 12/2002 Petzold ..... 701/211

FOREIGN PATENT DOCUMENTS

| | | |
|---|---|---|
| DE | 44 23 328 | 1/1996 |
| DE | 195 31 824 | 4/1996 |
| DE | 197 53 170 | 6/1998 |
| DE | 298 12 320 | 10/1998 |
| DE | 197 37 256 | 3/1999 |
| DE | 198 53 558 | 2/2000 |
| DE | 695 26 346 | 5/2002 |

* cited by examiner

*Primary Examiner*—Hung Nguyen
(74) *Attorney, Agent, or Firm*—Kenyon & Kenyon

(57) ABSTRACT

A method for determining and outputting travel instructions is described, which functions to support a user through travel instructions, a sequence of travel instructions being determined by a central station, so that a data terminal of a user may be configured in a simple manner.

16 Claims, 2 Drawing Sheets

METHOD FOR DETERMINING AND OUTPUTTING TRAVEL INSTRUCTIONS

FIELD OF THE INVENTION

The present invention relates to a method for determining and outputting travel instructions.

BACKGROUND INFORMATION

A method and system for navigating a vehicle is already known from European Patent Application No. 715 289, a vehicle being guided by an on-board navigational system, on the basis of an on-board digitized street map, along a travel route determined by a traffic guidance system. Planning data are transmitted from the vehicle to the external traffic computer, in accordance with which a complete travel route, determined by the traffic computer, is transmitted to the vehicle. By comparing the current position with the travel route on the basis of the digitized street map, the navigation is performed in the vehicle by an on-board computer, which determines the appropriate travel instructions and which may announce them over a loudspeaker and optically via a display. To be able to output current travel instructions, it may be required in this context that the navigational device in the vehicle access a street map, which is either carried in the vehicle or is transmitted by the traffic guidance system. For the street map, a corresponding amount of storage space may be required. Furthermore, the arithmetic unit may be required to first determine the travel instructions for a driver from the transmitted route.

SUMMARY OF THE INVENTION

In contrast, an example method according to the present invention may provide that a sequence of travel instructions may be transmitted from the central station, it only being required for an arithmetic unit in the vehicle to output the travel instructions in the corresponding sequence. As a result, calculating the travel instructions in the vehicle may be dispensed with as well as with carrying a digital street map, which may entail high storage space requirements. In this context, current street links may be directly taken account of in the central station. For example, if the vehicle is moving in an area that is known to the user, no travel instructions are output but are requested only when required, for example, over the Internet, so that, on the one hand, the transmission costs for a user may be minimal and, on the other hand, for travel outside the area that is known to the vehicle user, for example, assistance may be rendered the driver in the outputting of current travel instructions. The arithmetic unit may be configured solely for reproducing travel instructions and therefore in a simple manner, e.g., having minimal working memory and low computing power, so that the arithmetic unit may be conceived as being inexpensive.

The arithmetic unit may be connected via the Internet to the central station, because as a result an inexpensive and rapid access to the central station may be assured anywhere in the world, without requiring high telephone costs, e.g., for telephone calls from abroad conducted on a cellular telephone.

The arithmetic unit may be linked to the central station via a radio connection, so that a mobile use of the arithmetic unit may be possible, e.g., in a vehicle.

Also, after a first retrieval, the sequence of travel instructions may be stored in the central station for a specifiable period of time and may be updated if required. As a result, the already calculated route may be retrieved once again, e.g., using a different arithmetic unit. An arithmetic unit may also be provided in a public operating console, so that travel instructions may be retrieved by the user even when the user himself is not carrying a device with which he may access the central station.

Furthermore, a travel route may be determined via a first arithmetic unit located on a device that may be suited for inputting, for example, a fixed personal computer, and to transmit it to a central station, from which the sequence of travel instructions may be retrieved thereafter, so that a device by which the sequence of travel instructions is retrieved may not be required to have a device, or only a simple one, for inputting a destination or for determining a travel route. In this context, a user may comfortably plan a travel route using his computer at home while taking account of personal preferences, interesting sights, and roads to be avoided. The preferences, interesting sights, and roads to be avoided may be input on his home PC, because, in contrast to a device in the vehicle, the usual input possibilities may be available via keyboard and mouse.

A user may enter into the arithmetic unit the reaching of a position, so that the arithmetic unit may have the information concerning the point on the travel route at which a user is located. As a result, a locator device may be dispensed with. Furthermore, if a user wishes to avoid these inputs, the arithmetic unit may be expanded such that it may have connected to it a locator device which may determine the position of the arithmetic unit and which may be offered, e.g., as a supplementary retrofit assembly kit for the arithmetic unit.

Travel instructions may be given for a driver of a vehicle and/or instructions may be given for the use of public transportation. In this context, the central station, via the Internet, may fall back on other service providers and, in this manner, may increase the information available to it.

An arithmetic unit may be arranged, which may function to perform the method, in a car radio, so that no additional device may be required to be disposed in the vehicle.

DETAILED DESCRIPTION

An example method according to the present invention may be used by various traffic participants, e.g., pedestrians, bicyclists, users of buses and trains, as well as users of motor vehicles. In the case of users of motor vehicles, an arithmetic unit which is in contact with a central station, may be fixedly arranged in the motor vehicle. The other traffic participants may have on board either a corresponding arithmetic unit or they may use publicly accessible service devices having corresponding arithmetic units, using which the devices may be brought into contact with the central station. A user may remove the arithmetic unit from the vehicle and, e.g., continue to use it as a pedestrian. In what follows, an arithmetic unit arranged in a vehicle is described as an example embodiment.

Figure 1:
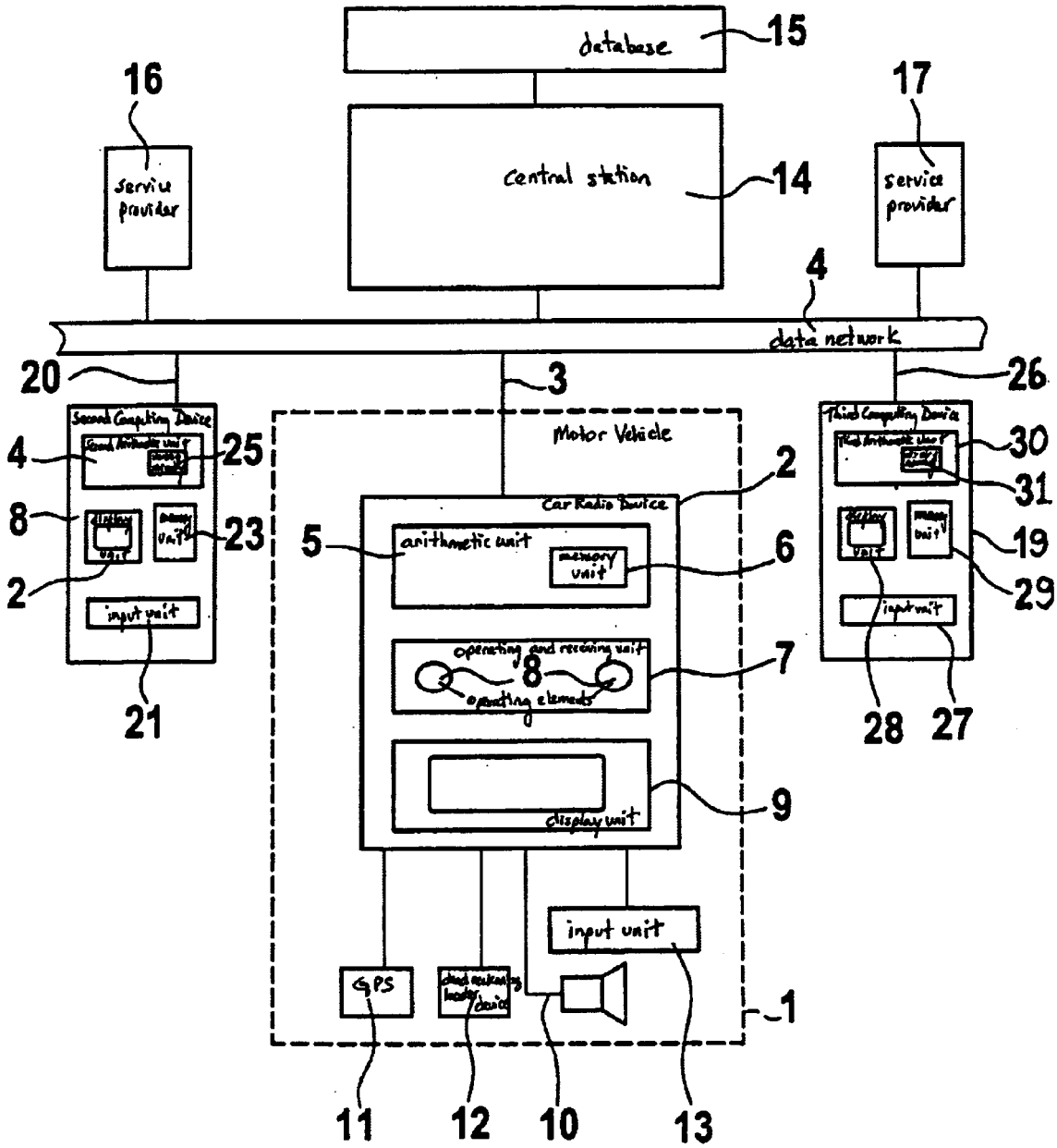
FIG. 1 illustrates a device for performing an example method of the present invention, having a central station, an arithmetic unit, and an Internet connection.

In FIG. 1, a car radio device 2 is depicted, which is arranged in a motor vehicle 1, which is depicted only symbolically by dotted lines. The car radio device is connected via a first data circuit 3 to a data network 4. Car radio device 2 has a first arithmetic unit 5 having a memory unit 6. The car radio device therefore may also constitute a first computing device. On car radio device 2, an operating and receiving unit 7 is represented as having operating elements 8 and receiving and amplifying devices that are not depicted in the Figure. In addition, car radio device 2 is provided with a display unit 9. Car radio device 2 is also connected to at least one loudspeaker 10. In one example embodiment, car radio device 2 is also connected to a GPS receiver 11, a dead reckoning locator device 12, and an input unit 13. Via first data circuit 3, a connection may be set up from car radio device 2 to a central station 14. Central station 14 is connected to a database 15. Central station 14 may also be connected to further service providers 16, 17, which are also connected to data network 4. In addition, a second computing device 18 and a third computing device 19 are connected to data network 4. Second computing device 18 may be executed as a personal computer, which is fixedly arranged, e.g., in a residence or at a workstation of a user. Second computing device 18 is connected via second data circuit 20 to data network 4. Second computing device 18 has an input unit 21, a display unit 22, a memory unit 23, and a second arithmetic unit 24, which has a working memory 25. Third computing device 19 is connected via a third data circuit 26 to data network 4. Third computing device 19 also has an input unit 27, a display unit 28, a memory unit 29, as well as a third arithmetic unit 30, and a working memory 31.

In one example embodiment, car radio device 2 is arranged in a central console of motor vehicle 1, so that it may be seen clearly and manipulated by a driver and by a passenger of the vehicle. In a first example embodiment, a destination is entered into car radio device 2 via an input unit 13, which is also located within reach of the driver, and/or via operating elements 8. In addition, first arithmetic unit 5, by reverting to GPS receiver 11 (GPS=Global Positioning System), determines a geographical position of the vehicle. If a satellite connection is not available, then the position may be determined using dead reckoning locator device 12. In a further example embodiment, a GPS receiver 11 or a dead reckoning locator device 12 is not connected to car radio device 2, and a starting position is also input into car radio device 2 via input unit 13 or via operating elements 8.

First arithmetic unit 5 via first data circuit 3, establishes a connection to data network 4. Data network 4 may be the Internet, for example. First data circuit 3, in this context, may be achieved via a mobile radiocommunications interface arranged in motor vehicle 1 and not depicted in FIG. 1, the mobile radiocommmunications interface establishing via mobile radio telephony a connection to an Internet provider, through which in turn a connection to the Internet is set up. For an Internet connection, the car radio device may be provided with an operating system for a small computer to access, e.g., the World Wide Web (WWW) using a suitable data protocol. In one example embodiment, car radio device 2 using the WAP (Wireless Application Protocol) may access the Internet. The mobile radio communications interface may be executed as a GSM- or as a UMTS-interface (UMTS=Universal Mobile Telecommunications System). The Internet address of central station 14 may be stored in memory unit 6 of first arithmetic unit 5. Via first data circuit 3, the starting point and the destination are communicated to central station 14. Central station 14, in this context, by reverting to database 15, determines the speediest and/or shortest route from the starting point to the destination. Database 15 has a data carrier having a digitized street map of a street and route network. In one example embodiment, central station 14, in this context, falls back on further service providers 16, 17, which are also connected to data network 4. These service providers may be, e.g., providers of traffic and road condition information or of schedules, e.g., of ferries, trains, and/or airlines. In addition, further service providers 16, 17 may also be Internet providers for the route search, transmitting appropriate travel routes to central station 14. From the travel route determined by central station 14, central station 14 determines a sequence of travel instructions. The sequence of travel instructions is transmitted from central station 14 via data network 4, and over first data circuit 3, back to car radio device 2. In one example embodiment, an identification of a user may occur with respect to the central station 14 by inputting a code using input unit 13 and by transmitting the code via first data circuit 3. In this manner, the retrieval of a sequence of travel instructions may be charged to a user, e.g., by debiting an account or by charging a credit card. The received sequence of travel instructions is stored in memory unit 6 by first arithmetic unit 5. Subsequently, the travel instructions are output by car radio device 2 via display unit 9 and/or via loudspeaker 10. A first travel instruction is displayed, e.g., in display unit 9, for example, "at Stuttgart intersection, switch to A 831." If it is now determined by the GPS receiver that the Stuttgart intersection has been reached, then the next travel instruction is output, thus, e.g., "leave the autobahn at Vaihingen." For this purpose, a geographical position is assigned to the travel instructions, the position being transmitted to the arithmetic unit along with the travel instruction. If the Vaihingen exit is reached, then the next travel instruction is output. Further outputs of travel instructions follow until the destination is reached. In one further example embodiment, a user may also communicate to car radio device 2, through an appropriate manipulation of the operating elements 8, that the displayed position, e.g., the Stuttgart intersection, has been reached. A dead reckoning locator device 12 or a GPS receiver 11 may not be required in this example embodiment. While the example method is being performed, if no travel instructions are being output, music received via the receiving device of car radio device 2 may be outputted over loudspeaker 10. Display unit 9 is executed in one example embodiment as a liquid crystal display, e.g. as a dot-matrix display, using which, in one example embodiment, at least text information and simple graphics may be output, so that an inexpensive display may be used as display unit 9.

In place of car radio device 2 arranged in the motor vehicle 1, second computing device 18 may be connected to data network 4, route planning, in one example embodiment, being performed by a user through second computing device 18. Via input unit 21, a user inputs the start and destination into second arithmetic unit 24, which by reverting to memory unit 23 displays a desired route in display unit 22, a route which a user may in turn select via input unit 21.

In a first example embodiment, the travel route determined in this manner is transmitted to central station 14 in the same manner via second data circuit 20, on which the starting and destination points determined by car radio device 2 are also transmitted to central station 14. In a further example embodiment, a travel route is already determined by second arithmetic unit 24 through accessing memory unit 23, e.g., a data carrier having a stored digital street map, and a sequence of travel instructions is generated from the travel route. Via second data circuit 20, this sequence of travel instructions is transmitted to central station 14, where the sequence of travel instructions is stored. This sequence of travel instructions may subsequently be retrieved by a user from car radio device 2, so that for a user a data transmission occurs from second computing device 18 via central station 14 to car radio device 2 and memory unit 6 of first arithmetic unit 5. In one example embodiment, a user identifies himself through inputting, using input unit 13, a code previously established by him, the input code being transmitted from first arithmetic unit 5 to central station 14. In a further example embodiment, the travel instructions stored in the central station may be modified as a function of current information from the central station and for the modified travel instructions to be transmitted to car radio device 2.

In a further example embodiment, central station 14 may be accessed from a third computing device 19 over a third data circuit 26, using data network 4. Third computing device 19 is executed as a public operating device, which may be arranged, e.g., in railway stations, airports, or in downtown areas, so that from the aforementioned locations a user may access central station 14 and may also retrieve his travel route, previously transmitted to central station 14 using second computing device 18, in the form of sequences of travel instructions, or so that he may directly retrieve the travel instructions transmitted to central station 14. In this context, it may not be required that a user himself have his own device on board. In one example embodiment, the third arithmetic unit is also provided with a memory unit 29, in which a street map is stored, so that in the example embodiment a user may also determine a travel route using the third arithmetic unit and may transmit a sequence of travel instructions to central station 14. This may be desirable when travel instructions are desired for the use of public transportation. Because one travel route may be retrieved by a user from different arithmetic units, the sequence of travel instructions remains stored in central station 14 for a pre-established period of time, e.g., two days, so that a user may retrieve the travel route from a plurality of arithmetic units, e.g., from car radio device 2, or from a public computing device, in the form of third computing device 19.

Travel instructions for a car driver may generally be information for the automobile driver concerning locations at which he should turn off from a street in a given direction. In addition, the travel instructions may also support a car driver by confirming to the driver that he is still following the correct route. With respect to using public transportation, travel instructions may be information concerning which train and/or bus or which airplane should be selected at a given point in time from a given location.

In a further example embodiment, car radio device 2 may be removed from motor vehicle 1, thus also providing theft protection for car radio device 2. Using a self-sufficient voltage source in car radio device 2, not depicted in FIG. 1, travel instructions may be from central station 14 outside motor vehicle 1, e.g., for public transportation.

Figure 2:
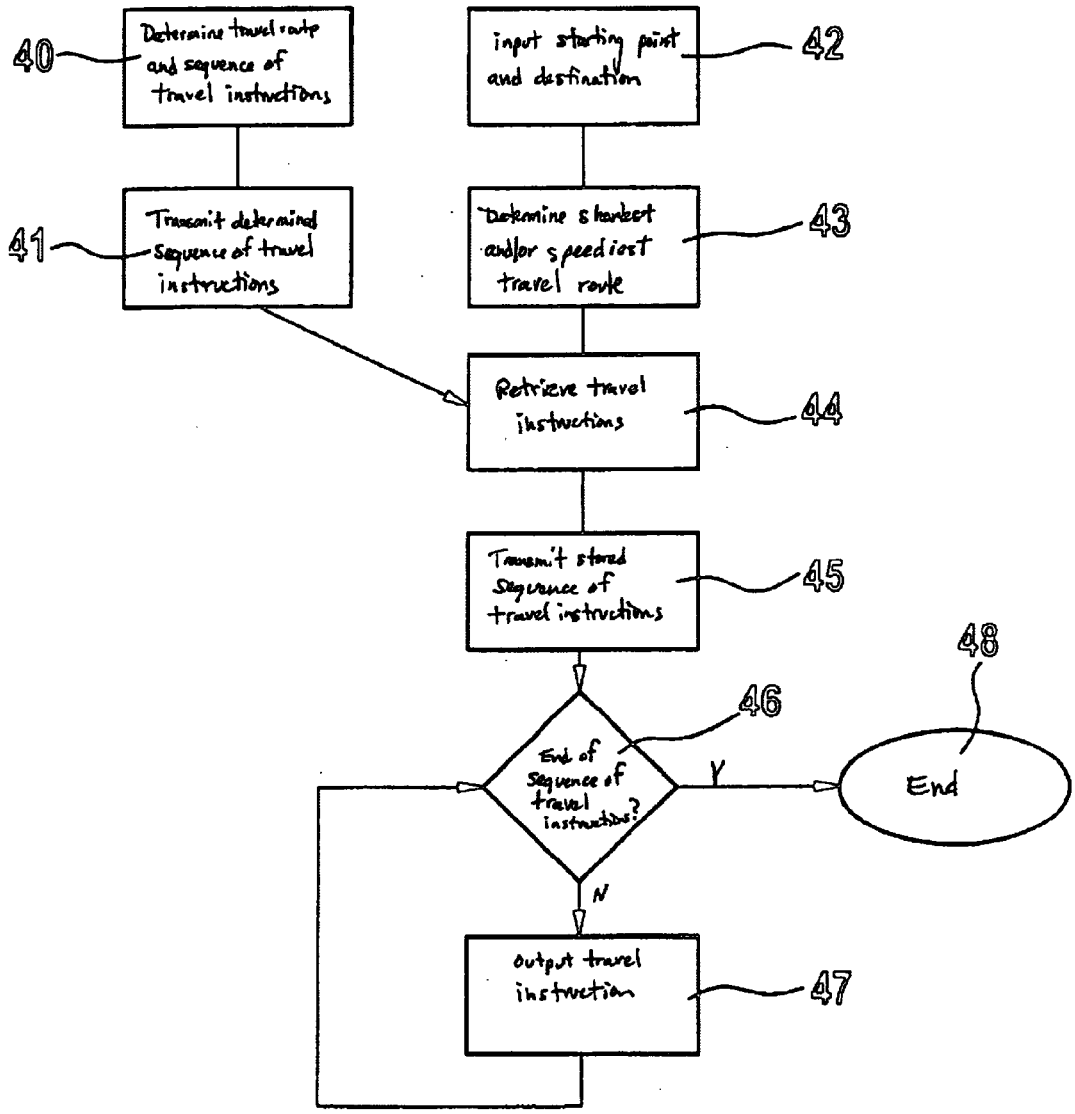
FIG. 2 illustrates two method sequences, shown in combination, for performing an example method according to the present invention.

In FIG. 2, an example method according to the present invention is depicted, having two different starting positions of the method. In a first example embodiment, a travel route and a sequence of travel instructions are first determined in an inquiry step 40 using second computing device 18. In a subsequent transmission step 41, the determined sequence of travel instructions is transmitted via data network 4, e.g. the Internet, to central station 14. In a further example embodiment, a method sequence according to the present invention begins with an input-transmission step 42, in which a starting point and destination are input into car radio device 2 and are transmitted from the first arithmetic unit to central station 14. In a subsequent determination step 43, from the starting point and the destination, the shortest and/or speediest travel route is determined between the starting point and the destination, and from this a sequence of travel instructions is generated and stored by central station 14 for a driver of the vehicle. A retrieval step 44 follows both determination step 43 as well as transmission step 41, the method after retrieval step 44 proceeding in the same manner for both of the method beginnings according to the present invention indicated above. In retrieval step 44, the sequence of travel instructions is requested via data network 4 by central station 14. An identification of the user may occur in this context. In a further example embodiment, if a starting point and destination have been transmitted to central station 14, a retrieval step may be dispensed with, by automatically starting a transmission of a sequence of travel instructions by central station 14 as soon as central station 14 has calculated the sequence of travel instructions. In a subsequent transmission step 45, the stored sequence of travel instructions is transmitted from central station 14 to car radio device 2 and is stored in memory unit 6. In a subsequent check step 46, a check test is performed by first arithmetic unit 5 as to whether the end of the sequence of travel instructions has been reached. If this is not the case, then a branching occurs to an output 47 of the next travel instruction. If output 47 was not previously reached, then the first travel instruction of the sequence of travel instructions is output. When output 47 is reached, the travel instruction pending for outputting is acoustically output once over loudspeaker 10, e.g. in the form of speech. In display unit 9, the travel instruction is displayed until a user has indicated, via operating elements 8, that he has reached the position indicated in the travel instruction or until the fact of reaching or going beyond the corresponding position has been established by GPS receiver 11 or dead reckoning locator device 12. For this purpose, position data may be assigned to the travel instruction, so that first arithmetic unit 5 may perform a comparison between the position assigned to the travel instruction and the position determined by GPS receiver 11 or dead reckoning locator device 12. If it is determined by first arithmetic unit 5 that the position has been reached, then a branching occurs back to check step 46. If in check step 46 it is determined that no further travel instruction is present, then a branching occurs to an end step 48, in which the example method according to the present invention is ended. In this context, display unit 9 displays, e.g., the text "destination reached."

What is claimed is:

1. A method for determining and outputting travel instructions for a travel route from a starting point to a destination, comprising:

connecting an arithmetic unit, at least temporarily, with a central station;

transmitting the starting point and the destination to the central station;

determining the travel route by the central station;

determining a sequence of the travel instructions by the central station from the travel route;

transmitting the sequence of the travel instructions from the central station to the arithmetic unit;

storing the sequence of the travel instructions in the arithmetic unit;

outputting the travel instructions by the arithmetic unit, one after another, in accordance with the sequence of the travel instructions;

continuing to store the sequence of the travel instructions in the central station after a first retrieval for a specifiable period of time; and updating the stored sequence of the travel instructions during the specifiable period of time.

2. The method according to claim 1, further comprising:

arranging the arithmetic unit in a mobile computing device; and linking the arithmetic unit to the central station via a radio connection.

3. The method according to claim 1, further comprising:

retrieving the travel instructions by the arithmetic unit using a publicly accessible operating device.

4. The method according to claim 1, further comprising:

planning the travel route by a fixed second arithmetic unit;

transmitting the sequence of the travel instructions relating to the travel route to a central station; and retrieving the sequence of the travel instructions by the first arithmetic unit from the central station.

5. The method according to claim 4, further comprising:

arranging the fixed second arithmetic unit in a personal computer.

6. The method according to claim 1, further comprising:

assigning positions on the travel route to the travel instructions;

inputting into the arithmetic unit by a user a fact of reaching a position; and outputting the travel instructions as a function of a position that is input.

7. The method according to claim 1, further comprising:

connecting a locator device to the arithmetic unit;

determining a position of the arithmetic unit using the locator device; and outputting a travel instruction from the sequence of the travel instructions as a function of the position of the arithmetic unit.

8. The method according to claim 1, further comprising:

making a provision in the travel instructions for travel instructions for a driver of a vehicle.

9. The method according to claim 1, further comprising:

connecting the central station, via a data network, to further service providers; and generating the sequence of the travel instructions through access to other service providers.

10. The method according to claim 9, wherein the data network includes the Internet.

11. The method according to claim 1, wherein the arithmetic unit connected to the central station via the Internet.

12. The method according to claim 1, further comprising:

making a provision in travel instructions for travel instructions for a use of public transportation.

13. The method according to claim 1, wherein the travel instructions include instructions to make a turn from a street at a given location.

14. An arithmetic unit for outputting travel instructions for a travel route from a starting point to a destination, comprising:

a connecting arrangement for connecting, at least temporarily, with a central station remotely located with respect to the arithmetic unit and for transmitting the starting point and the destination to the central station;

a memory arrangement for storing a sequence of the travel instructions transmitted from the central station to the arithmetic unit; and an outputting arrangement for outputting the travel instructions, one after another, in accordance with the sequence of the travel instructions;

wherein the sequence of the travel instructions are continued to be stored in the central station after a first retrieval for a specifiable period of time, and the stored sequence of the travel instructions are updated during the specifiable period of time.

15. The arithmetic unit according to claim 14, wherein the arithmetic unit is arranged in a car radio device.

16. A central station for determining travel instructions for a travel route from a starting point to a destination, comprising:

a connection arrangement for connecting, at least temporarily, with an arithmetic unit and for receiving the starting point and the destination, the central station being remotely located with respect to the arithmetic unit;

a determination arrangement for determining a travel route and the travel instructions; and a transmission arrangement for transmitting a sequence of the travel instructions from the central station to the arithmetic unit;

wherein the sequence of the travel instructions are continued to be stored in the central station after a first retrieval for a specifiable period of time, and the stored sequence of the travel instructions are updated during the specifiable period of time.

* * * * *